US006482023B1

(12) United States Patent
Tan

(10) Patent No.: US 6,482,023 B1
(45) Date of Patent: Nov. 19, 2002

(54) TERMINAL FOR IC CHIP HOLDER

(75) Inventor: Ying-Wu Tan, Taoyuan (TW)

(73) Assignee: Speed Tech Corp., Taoyuan Hsien (TW)

( * ) Notice: Subject to any disclaimer, the term of this patent is extended or adjusted under 35 U.S.C. 154(b) by 0 days.

(21) Appl. No.: 10/036,519

(22) Filed: Jan. 7, 2002

(51) Int. Cl.[7] ..... H01R 13/625
(52) U.S. Cl. ..... 439/342
(58) Field of Search ..... 439/342, 884, 439/70, 71

(56) References Cited

U.S. PATENT DOCUMENTS 5,454,727 A * 10/1995 Hsu ..... 439/263
5,529,511 A * 6/1996 Matsuoka ..... 439/259
5,569,045 A * 10/1996 Hsu ..... 439/259
5,797,774 A * 8/1998 Kaneko ..... 439/342
6,074,233 A * 6/2000 Lin ..... 439/342
6,312,276 B1 * 11/2001 Lin ..... 439/342
6,328,585 B1 * 12/2001 Matsuo ..... 439/342
6,328,587 B1 * 12/2001 Hsu ..... 439/259

* cited by examiner

*Primary Examiner*—Tulsidas Patel
(74) *Attorney, Agent, or Firm*—Rabin & Berdo, P.C.

(57) ABSTRACT

A terminal installed in one terminal slot of an IC chip holder and adapted to electrically connect one contact pin of an IC chip to a circuit board below. The terminal has two suspension arms transversely disposed at different elevations and adapted to clamp the corresponding contact pin of the IC chip and press the contact pin against the peripheral wall of the terminal slot, keeping the contact pin of the IC chip in positive contact with the terminal.

8 Claims, 6 Drawing Sheets

TERMINAL FOR IC CHIP HOLDER

BACKGROUND OF THE INVENTION

1. Field of the Invention

The present invention relates to a terminal for use in an IC chip holder to electrically connect one contact pin of an IC chip at the IC chip holder to a corresponding electric contact of a circuit board holding the IC chip holder and, more particularly, to such a terminal, which has two suspension arms adapted to clamp the corresponding contact pin of the IC chip and press the contact pin against the peripheral wall of the terminal slot, keeping the contact pin of the IC chip in positive contact with the terminal.

2. Description of the Related Art

Conventionally, the installation of an IC chip in a circuit board for use in a computer is achieved by directly soldering the respective contact pins of the IC chip to respective electric contacts of the circuit board. During soldering, the integrated circuit of the IC chip tends to be damaged by heat. In order to eliminate this problem, an IC chip holder may be used to support an IC chip on a circuit board. However, when fastening an IC chip to an IC chip holder, the contact pins of the IC chip tend to be deformed or damaged. Therefore, the arrangement between the contact pins of an IC chip and the terminals in the terminal slots of a matching IC chip holder is important. FIG. 7 illustrates a terminal A for use in an IC chip holder according to the prior art. The terminal A comprises a longitudinal support portion A2, a transversely extended flat top positioning portion A1, a curved suspension arm A21 extended from one side of the longitudinal support portion A2 and adapted to press the corresponding contact pin of the IC chip against the peripheral wall of the corresponding terminal slot in the IC chip holder, and a bottom mounting leg A3 adapted for fastening to the circuit board below. FIG. 8 shows another structure of terminal B according to the prior art. This structure of terminal B comprises a bottom mounting leg B2 adapted for fastening to a circuit board, a flat top contact base B1, a suspension arm B11 extended sideways from the flat top contact base B1 and terminating in an arched contact portion B12 for the contact of the corresponding contact pin of the IC chip. According to the aforesaid two prior art designs, the terminals A;B are disposed in contact with the corresponding contact pin of the IC chip at one contact point only. Because of one point contact, the contact between the terminal and the corresponding contact pin of the IC chip is unstable, and the IC chip tends to be forced out of position.

SUMMARY OF THE INVENTION

The present invention has been accomplished under the circumstances in view. It is the main object of the present invention to provide a terminal for IC chip holder, which holds the corresponding contact pin of the IC chip firmly in position for positive signal transmission after installation of the IC chip in the IC chip holder. According to the present invention, the terminal has two suspension arms transversely disposed at different elevations and adapted to clamp the corresponding contact pin of the IC chip and press the contact pin against the peripheral wall of the terminal slot, keeping the contact pin of the IC chip in positive contact with the terminal. Because the contact pin of the IC chip is supported in the corresponding terminal slot of the IC chip holder at three bearing points, the IC chip is prohibited from vibration.

DETAILED DESCRIPTION OF THE PREFERRED EMBODIMENT

Figure 1:
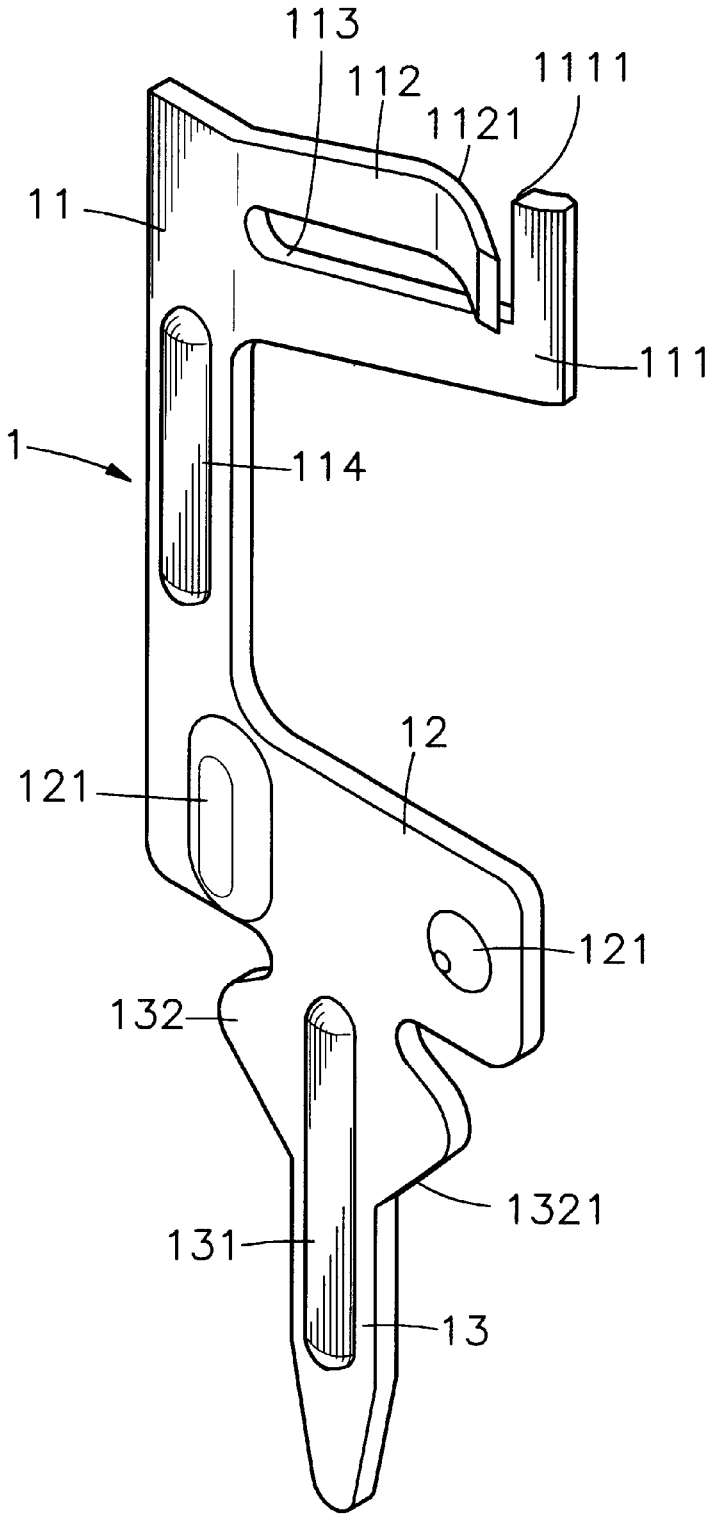
FIG. 1 is an elevational view of a terminal for IC chip holder constructed according to the present invention.

Referring to FIG. 1, a terminal 1 is shown comprising an elongated longitudinal support portion 11, a transverse positioning portion 12 perpendicularly extended from the bottom end of the longitudinal support portion 11 at one side, raised portions 121 respectively protruded from two sides of the transverse positioning portion 12, a longitudinal mounting leg 13 perpendicularly downwardly extended from a middle part of the bottom side of the transverse positioning portion 12, two protruded retaining portions 132 bilaterally connected between the transverse positioning portion 12 and the longitudinal mounting leg 13, a first longitudinal reinforcing rib 131 and a second longitudinal reinforcing rib 114 respectively formed in the longitudinal support portion 11 and the longitudinal mounting leg 13 to reinforce the structural strength of the terminal 1, a first suspension arm 111 perpendicularly extended from one side of the longitudinal support portion 11 and spaced above the transverse positioning portion 12 at a distance, a stop portion 1111 extended upwards from the free end of the first suspension arm 111, a second suspension arm 112 perpendicularly extended from the top end of the longitudinal support portion 11 above the first suspension arm 111, a contact face 1121 extended from the free end of the second suspension arm 112 and curved in one direction, and a gap 113 defined between the first suspension arm 111 and the second suspension arm 112. Further, the protruded retaining portions 132 each have a bottom slope 1321.

Figure 2:
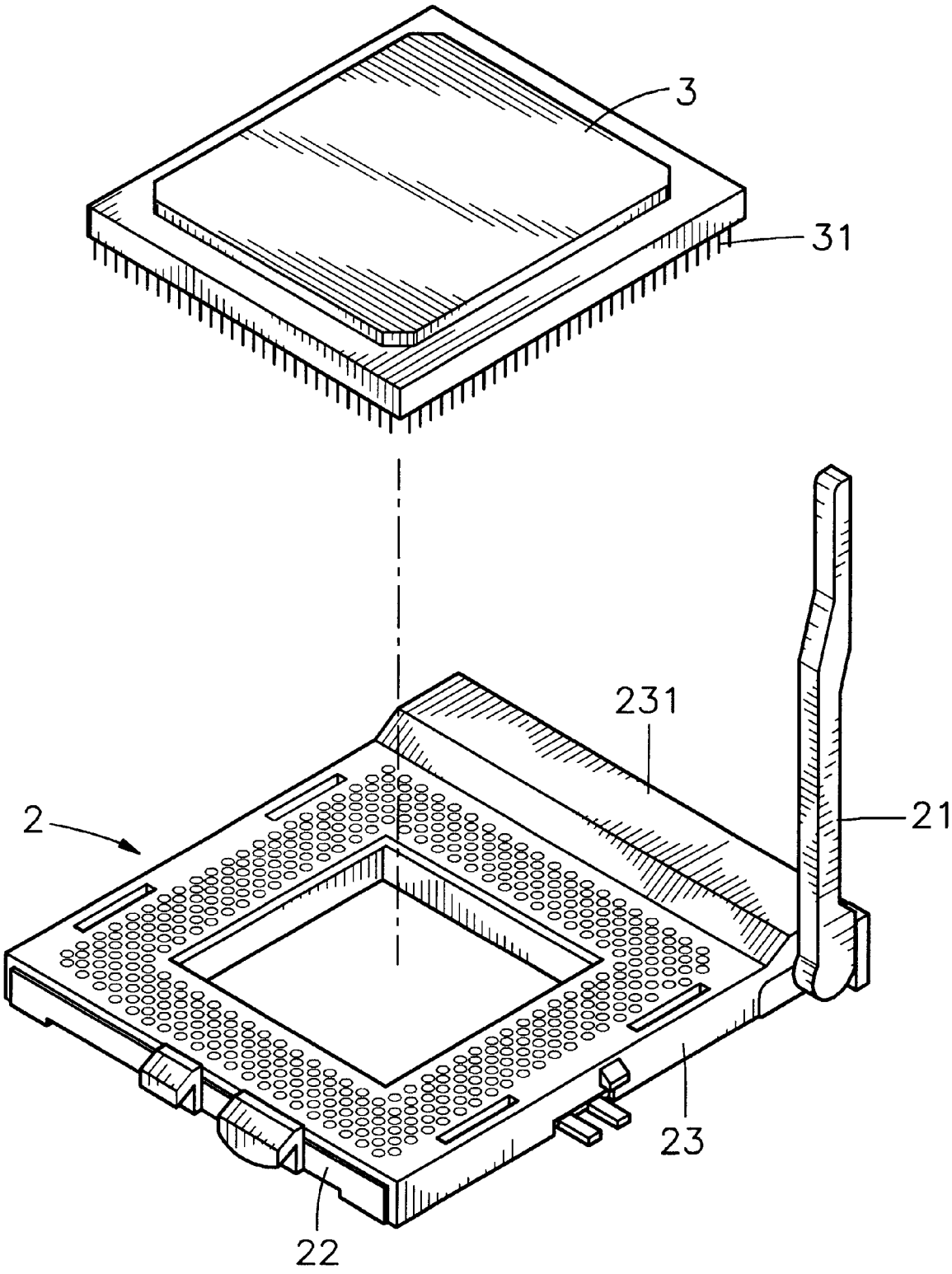
FIG. 2 illustrates an IC chip holder and an IC chip in which the terminal of the invention is used.
Figure 3:
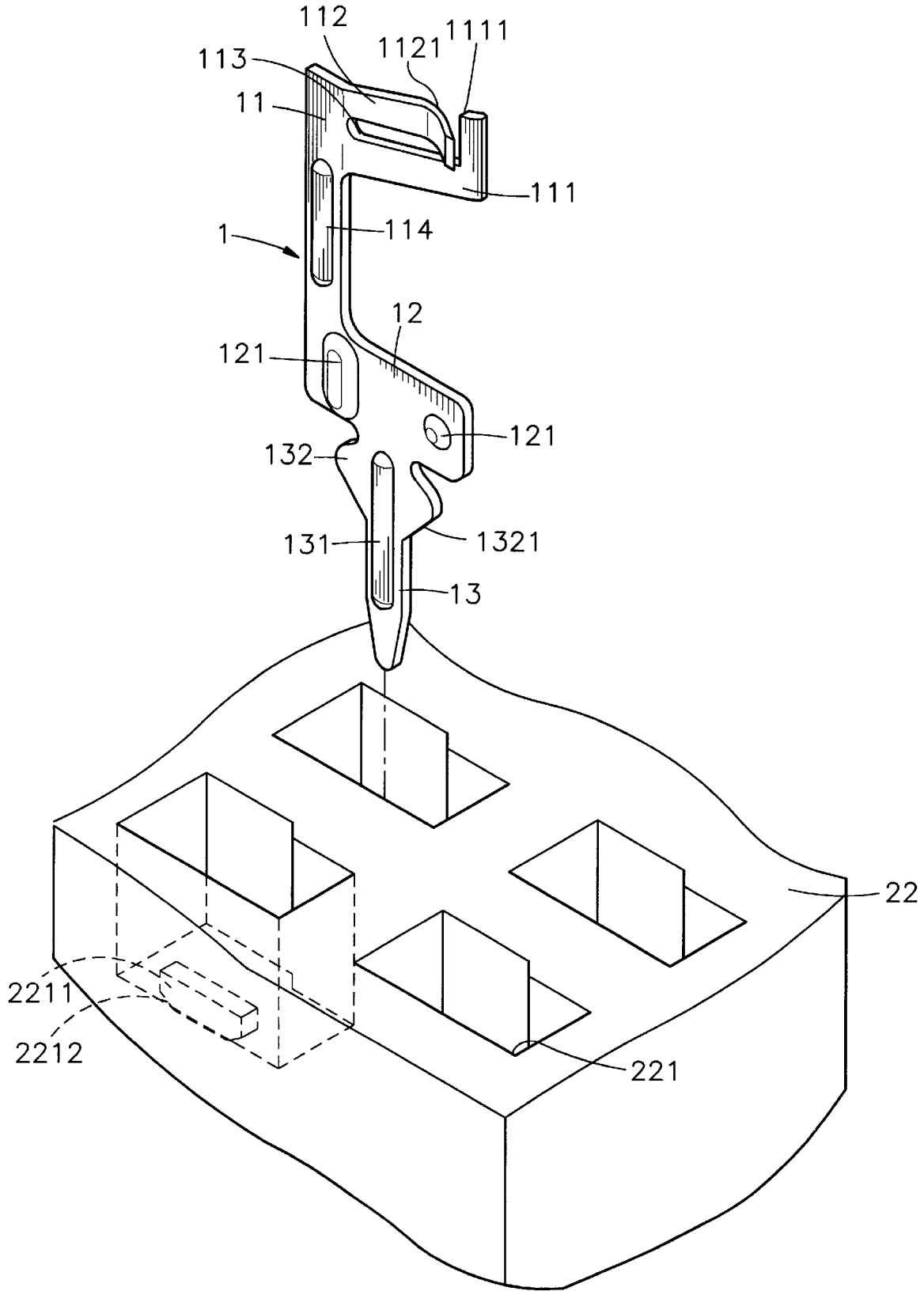
FIG. 3 is a perspective view showing the relationship between the terminal and one terminal slot of the IC chip holder according to the present invention.

Referring to FIGS. 2 and 3, during installation, the terminal 1 is inserted into one terminal slot 221 in the holder body 22 of the terminal holder 2 to force the longitudinal bottom leg 13 out of the corresponding bottom through hole 2211 in the terminal slot 221. By means of the bottom slopes 1321, the protruded retaining portions 132 can easily be forced into engagement with the peripheral wall of the bottom through hole 2211. When installed in the terminal slot 221, the protruded retaining portions 132 and the longitudinal rib 131 are respectively stopped against the peripheral wall of the bottom through hole 2211 to hold the terminal 1 in position, and the bottom slopes 1321 of the protruded retaining retaining portions 132 are respectively stopped at respective shoulder portions 2212 in the bottom through hole 2211.

Figure 4:
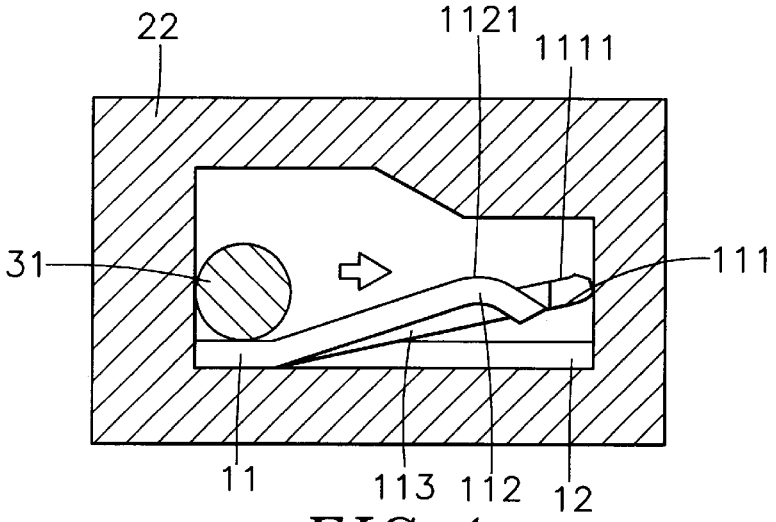
FIG. 4 is a top view in section showing the terminal mounted in the terminal slot and the contact pin of the IC chip holder inserted into the terminal slot.
Figure 5:
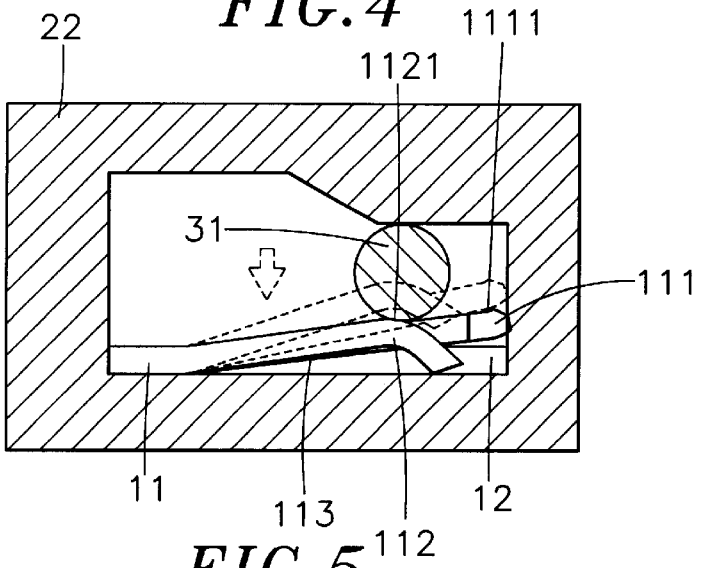
FIG. 5 is similar to FIG. 4 but showing the contact pin of the IC chip moved from the longitudinal support portion of the terminal to the suspension arms.
Figure 6:
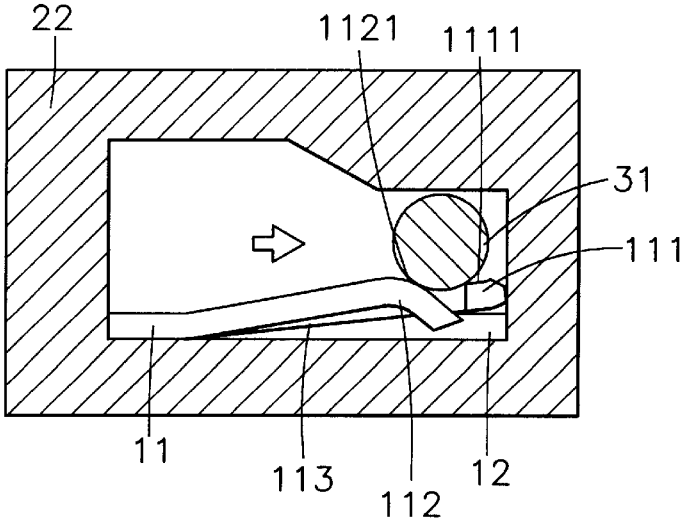
FIG. 6 is similar to FIG. 5 but showing the contact pin of the IC chip set into position and supported between the contact face and stop portion of the suspension arms of the terminal and the peripheral wall of the terminal slot of the IC chip holder.
Figure 7:
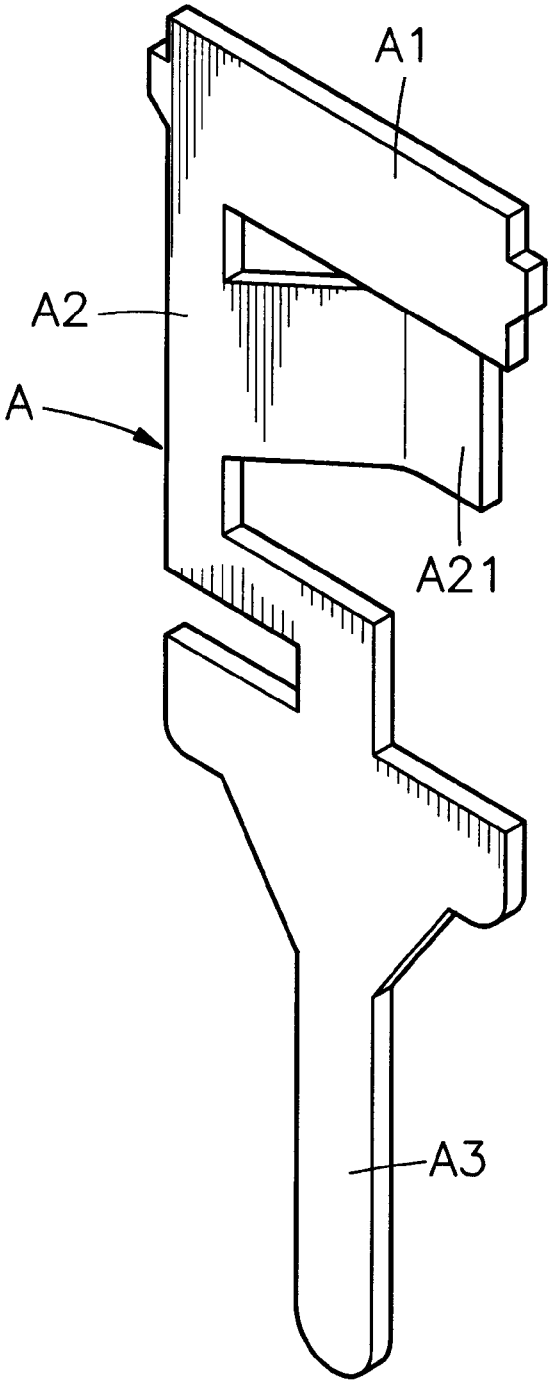
PRIOR ART FIG. 7
FIG. 7 is an elevational view of a terminal constructed according to the prior art.
Figure 8:
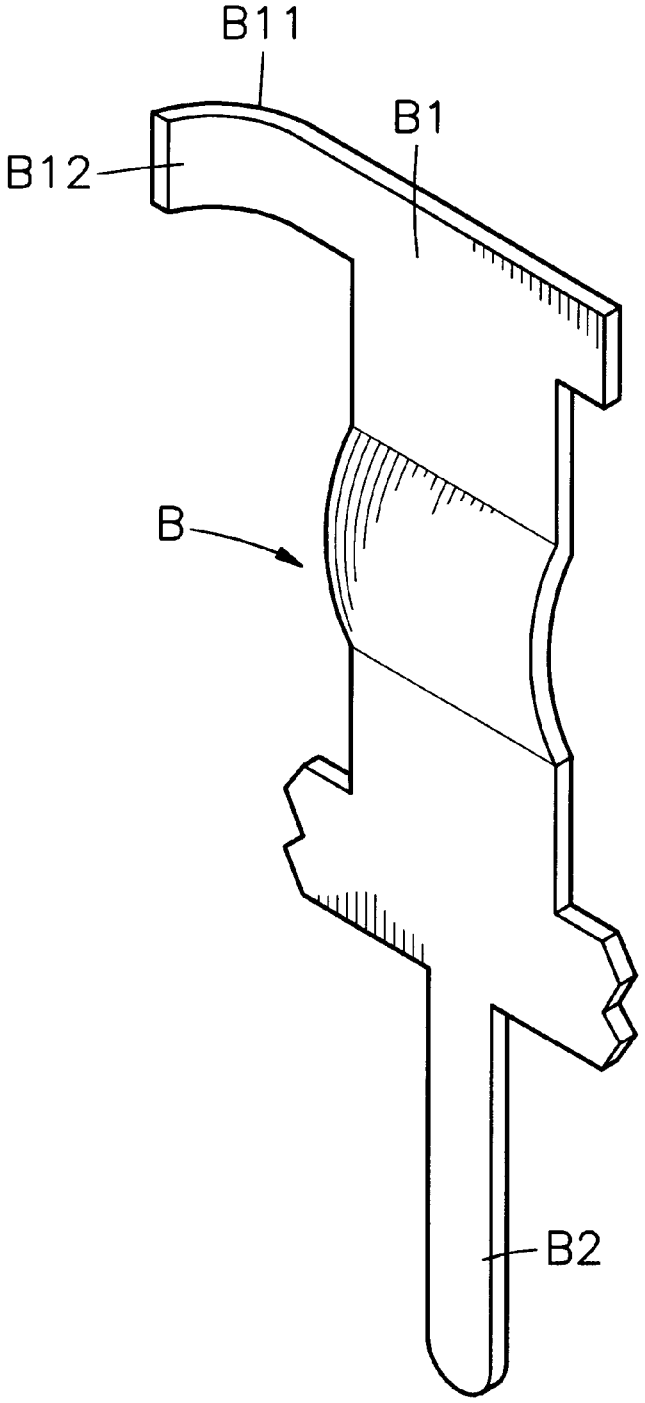
PRIOR ART FIG. 8
FIG. 8 is an elevational view of another structure of terminal constructed according to the prior art.

Referring to FIGS. from 4 through 6 and FIGS. 2 and 3 again, when attaching the IC chip 3 to the IC chip holder 2 to force the contact pins 31 of the IC chip 3 into the terminal slots 221 of the IC chip holder 2, the driving handle 21 is turned downwards from the vertical position to the horizontal position to move the slide 23 of the IC chip holder 2 and the IC chip 3 in one direction away from the protruding frame 231 of the IC chip holder 2 (see FIG. 4). At this time, the contact pins 31 of the IC chip 3 are respectively pressed against the contact faces 1121 of the terminals 1 in the terminal slots 221 of the IC chip holder 2 and forced into the gap 113 between the first suspension arm 111 and second suspension arm 112 of the terminal 1 in each terminal slot 221 (see FIG. 5). When set into position, the contact pins 31 of the IC chip 3 are respectively retained between the contact faces 1121 and stop portions 1111 of the terminals 1 in the terminal slots 221 of the IC chip holder 2 and peripherally stopped against the peripheral walls of the terminal slots 221 of the IC chip holder 2 (see FIG. 6).

The first suspension arm 111 and the second suspension arm 112 are cut from a material part at one side of the longitudinal support portion 11. Because the contact face 1121 is curved from the free end of the second suspension arm 112 in one direction, it provides a spring power to force the respective contact pin 31 of the IC chip 3 against the stop portion 1111. Therefore, the respective contact pin 31 of the IC chip 3 is positively maintained in contact with the terminal 1 between the contact face 1121 and the stop portion 1111. Because the contact pins 31 of the IC chip 3 are respectively supported at three bearing points, i.e., the contact faces 1121 and stop portions 1111 of the terminals 1 in the terminal slots 221 of the IC chip holder 2 and the peripheral wall of each terminal slot 221 of the IC chip holder 2, the invention eliminates vibrations between the contact pins 31 of the IC chip 3 and the terminals 1 in the terminal slots 221 of the IC chip holder 2.

A prototype of terminal for IC chip holder has been constructed with the features of the annexed drawings of FIGS. 1~6. The terminal for IC chip holder functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A terminal for use in an IC chip holder to electrically connect one contact pin of an IC chip mounted on said IC chip holder to a respective electric contact of a circuit board holding said IC chip holder, comprising an elongated longitudinal support portion, a transverse positioning portion perpendicularly extended from a bottom end of said longitudinal support portion at one side, a longitudinal mounting leg perpendicularly downwardly extended from a middle part of said transverse positioning portion, a first suspension arm perpendicularly extended from one side of said longitudinal support portion and spaced above said transverse positioning portion at a distance, and a second suspension arm perpendicularly extended from a top end of said longitudinal support portion above said first suspension arm, wherein said first suspension arm has a free end terminating in an upwardly extended stop portion for stopping the corresponding contact pin of the IC chip in contact with the terminal; said second suspension arm has a free end terminating in a curved contact face for pressing the corresponding contact pin of the IC chip against said upwardly extended stop portion and the peripheral wall of the corresponding terminal slot of the IC chip holder.

2. The terminal as claimed in claim 1 further comprising a gap defined between said first suspension arm and said second suspension arm.

3. The terminal as claimed in claim 1 further comprising a reinforcing rib longitudinally disposed in said longitudinal support portion.

4. The terminal as claimed in claim 1 further comprising a plurality of raised portions respectively protruded from two sides of said transverse positioning portion.

5. The terminal as claimed in claim 1 further comprising two protruded retaining portions bilaterally connected between said transverse positioning portion and said longitudinal mounting leg for positioning in a bottom through hole of the corresponding terminal slot of the IC chip holder.

6. The terminal as claimed in claim 5, wherein said protruded retaining portions each have a bottom slope.

7. The terminal as claimed in claim 1 further comprising a reinforcing rib longitudinally disposed in said longitudinal mounting leg.

8. The terminal as claimed in claim 1, wherein the contact face of said second suspension arm curves in one direction at an angle relative to the stop portion of said first suspension arm.

* * * * *